US006535093B1

(12) United States Patent
Murata et al.

(10) Patent No.: US 6,535,093 B1
(45) Date of Patent: Mar. 18, 2003

(54) INDUCTOR

(75) Inventors: Satoshi Murata, Yokaichi (JP); Hideyuki Mihara, Shiga-ken (JP); Etsuji Yamamoto, Yokaichi (JP); Minoru Tamada, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 27 days.

(21) Appl. No.: 09/671,054

(22) Filed: Sep. 28, 2000

(30) Foreign Application Priority Data

Sep. 28, 1999 (JP) ..... 11-275024

(51) Int. Cl.[7] ..... H01F 27/02
(52) U.S. Cl. ..... 336/83; 336/192; 336/200
(58) Field of Search ..... 336/65, 83, 183, 336/192, 200, 232

(56) References Cited

U.S. PATENT DOCUMENTS 5,001,548 A 3/1991 Iversen

FOREIGN PATENT DOCUMENTS

| | | |
|---|---|---|
| JP | 1-199418 | * 8/1989 |
| JP | 5-343232 | * 12/1993 |
| JP | 087101815 | 3/2000 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

An inductor includes input-output terminal electrodes, a coil conductor connected between the input-output terminal electrodes, and dividing grooves arranged to extend outwardly of the coil conductor from the end portions of the coil conductor over the terminal electrodes so as to be substantially perpendicular to the winding direction of the spiral coil conductor.

23 Claims, 5 Drawing Sheets

INDUCTOR

BACKGROUND OF THE INVENTION

1. Field of the Invention

The present invention relates to an inductor and more particularly, to a surface mount inductor constructed for use in high-frequency circuits and other electronic apparatuses.

2. Description of the Related Art

A conventional surface mount inductor is shown in FIGS. 11 and 12. FIG. 11 is a perspective view showing the appearance of the inductor 1 and FIG. 12 is a development view of an electrode. In the inductor 1, terminal electrodes 3 and 4 are provided at both ends of a columnar winding core material which has a spiral coil 2 provided on an external surface thereof. The spiral coil 2 is arranged such that after a thin-film conductor has been formed on the entire surface of the columnar winding core material, a spiral groove 5 is formed in the thin-film conductor. The terminal electrodes 3 and 4 are ring-shaped so as to extend around the columnar winding core.

When an electric current flows through the inductor 1, electric current I flows into the initial end portion 2*a* of the spiral coil 2 via the terminal electrode 3 as shown in FIG. 12. Then, the electric current I, which has flowed through the spiral coil 2, flows from the inductor 1 from the end 2*b* via the terminal electrode 4.

Since the terminal electrodes 3 and 4 extend around the winding core, the electrodes function as a coil with one turn, that is, as a short-circuited ring. Accordingly, the magnetic field generated by the electric current flowing through the spiral coil 2 crosses the terminal electrodes 3 and 4 which are parallel to the spiral coil 2, and an induced current i flows through the terminal electrodes 3 and 4, respectively. In FIG. 12, the induced current i flowing through the terminal electrode 4 is not shown. The induced current i dissipates energy while it circulates through the terminal electrodes 3 and 4. Therefore, the conventional inductor 1 has a problem in that the Q-factor and inductance of the spiral coil 2 are very low.

Up to now, as a solution to this problem, a method of separating the spiral coil 2 and the terminal electrodes 3 and 4 and electrically connecting the coil 2 and electrodes 3 through a lead-out pattern was used. However, this method requires that the inductors be large and prevents the required reduction in weight and size reduction. Thus, it is not possible to use the lead-out pattern.

SUMMARY OF THE INVENTION

In order to overcome the problems described above, preferred embodiments of the present invention provide a small inductor having substantially circular electrodes that are prevented from functioning as a short-circuited ring, while achieving a very high Q-factor and inductance.

According to one preferred embodiment of the present invention, an inductor preferably includes a winding core, a coil conductor extending spirally around the winding core, substantially circular electrodes running nearly around the winding core and located outwardly of the coil conductor, and dividing grooves extending from the ends of the coil conductor over the substantially circular electrodes. Here, the length of the dividing groove is, for example, a half or more of the diameter of the coil conductor.

Since the substantially circular electrodes are partially divided by the dividing grooves, the substantially circular electrodes are prevented from functioning as a short-circuited ring. That is, even when the magnetic flux generated by the current flowing through the coil conductor crosses the substantially circular electrodes, it is difficult for the circulating currents to flow through the substantially circular electrodes.

Therefore, an inductor having superior characteristics can be obtained in which energy loss is suppressed and decreases in the Q-factor and the inductance of the coil conductor are prevented.

Other features, elements, characteristics and advantages of preferred embodiments of the present invention will become apparent from the following detailed description of preferred embodiments thereof with reference to the attached drawings.

DETAILED DESCRIPTION OF PREFERRED EMBODIMENTS

Hereinafter, preferred embodiments of an inductor according to the present invention are described with reference to the accompanying drawings.

Figure 1:
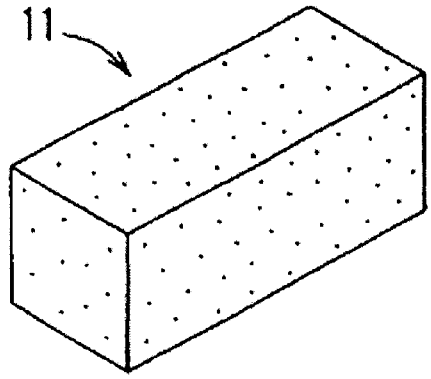
FIG. 1 is a perspective view showing a manufacturing step of a first preferred embodiment of an inductor according to the present invention.
Figure 2:
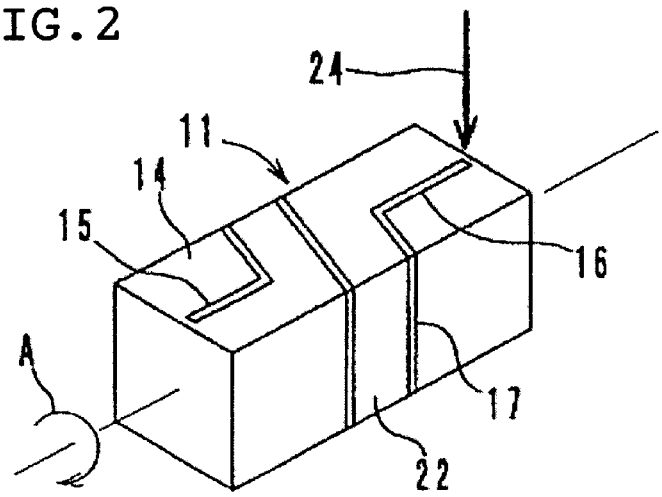
FIG. 2 is a perspective view showing a manufacturing step following the step shown in FIG. 1.

A preferred embodiment of the inductor according to the present invention and a manufacturing method therefor are described. As shown in FIG. 1, a winding core material 11 is columnar, preferably has a substantially rectangular transverse cross section, and is preferably made of a magnetic material such as ferrite, a ceramic material such as nonmagnetic alumina, a resin material, or other suitable material. On all of the surfaces of the winding core material, as shown in FIG. 2, a thin-film conductor 14 is formed by a method of plating, sputtering, or other suitable process. The thin-film conductor 14 is preferably made of copper (Cu), silver (Ag), silver-palladium (Ag—Pd), or other suitable material.

Next, both of the left and right ends of the winding core material 11 are inserted into the chucks of the spindle of a laser processing machine (not shown). Then, the left end portion of the winding core material 11 is irradiated with a laser beam 24 and the winding core material is scanned in its longitudinal direction by the laser beam 24. In this way, the thin-film conductor 14 irradiated with the laser beam 24 is removed to form a dividing groove 15. The length of the dividing groove 15 is preferably substantially equal to one half or more of the diameter of a spiral coil conductor 22 (to be described later).

Subsequently, the winding core 11 is rotated in the direction of an arrow A by driving the spindle. At the same time, the winding core 11 is irradiated with the laser beam 24 and is scanned in its longitudinal direction by the laser beam 24. Thus, the portion of thin-film conductor 14 irradiated with the laser beam 24 is removed, and then a groove 17 for the coil is formed, thereby completing a spiral coil 22. In this way, the coil conductor 22 spirally extending over the outer surface of the middle of the winding core 11 is provided.

Subsequently, after the rotation driven by the spindle has stopped, the winding core 11 is scanned in its longitudinal direction by the laser beam 24 and is irradiated at the right end portion. In this way, a dividing groove 16 is formed. The length of the dividing groove 16 is preferably substantially equal to one half or more of the diameter of the spiral coil conductor 22.

Figure 3:
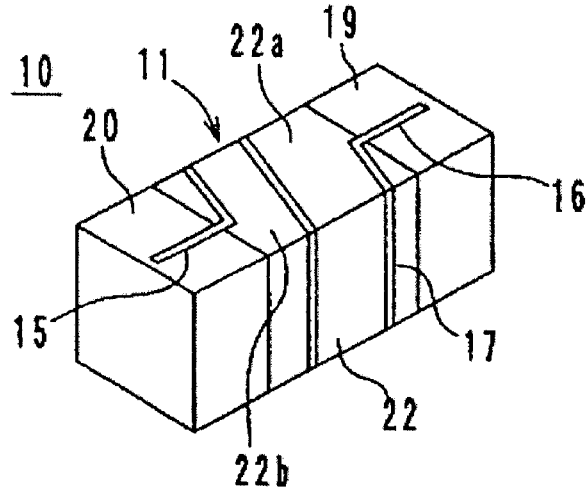
FIG. 3 is a perspective view showing the appearance of the inductor according to a preferred embodiment of the present invention.

Next, as shown in FIG. 3, by performing nickel plating, tin plating, or other suitable process, on both end portions of the winding core 11, input-output terminal electrodes 19 and 20 having excellent solderability are formed. The input-output terminal electrodes 19 and 20 are substantially circular so as to extend around the winding core 11. Furthermore, if required, the coil conductor 22 may be coated with an insulating cladding resin excluding the input-output electrodes 19 and 20 and is baked in order to protect the coil conductor 22.

In the inductor 10 having the above-described construction, the coil conductor 22 is connected between the input-output terminal electrodes 19 and 20. The dividing grooves 15 and 16 are arranged such that the grooves are substantially perpendicular to the winding direction of the spiral coil conductor 22 and such that the grooves extend in the outward direction of the coil conductor 22 from the end portions 22*a* and 22*b* of the coil conductor 22 into the terminal electrodes 19 and 20. Even if such dividing grooves 15 and 16 are provided in the outward direction of the coil conductor 22, the inductance is not adversely affected.

Figure 4:
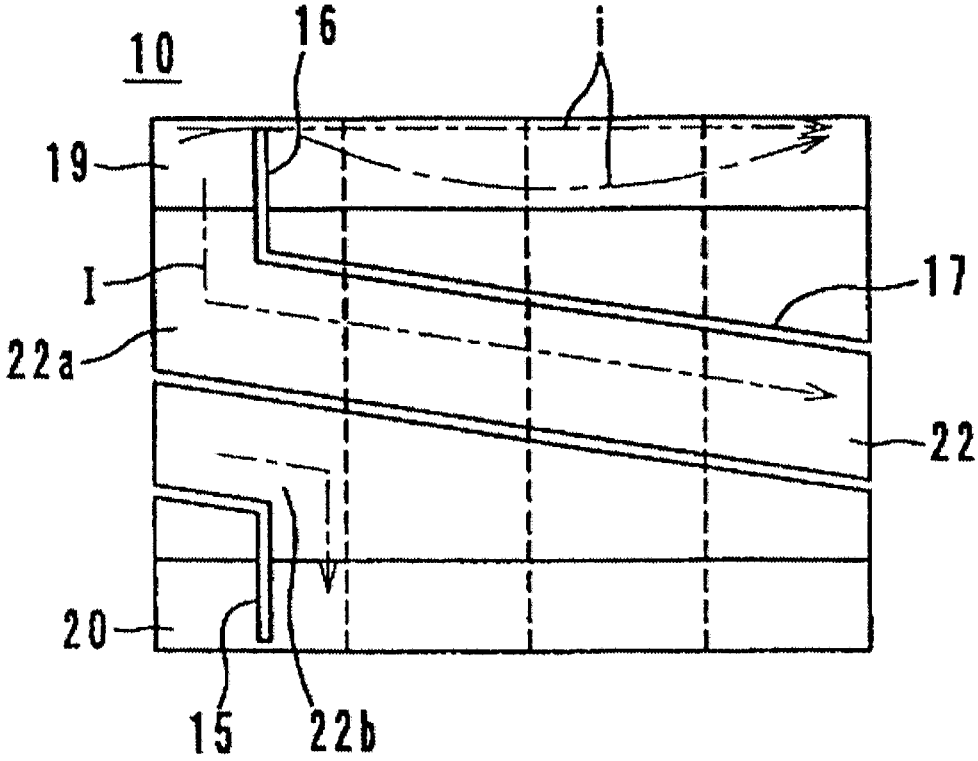
FIG. 4 is a development view of the inductor shown in FIG. 3.

When an electric current I flows through the inductor 10, as shown in FIG. 4, the electric current I flows into the initial end portion 22*a* of the spiral coil conductor 22 via the terminal electrode 19. Then, the electric current I which has flowed through the spiral coil conductor 22 flows out of the inductor 10 from the terminal end portion 22*b* via the terminal electrode 20.

Since the substantially circular terminal electrodes 19 and 20 are partially divided by the dividing grooves 16 and 15, the electrodes 19 and 20 are prevented from functioning as a short-circuited ring. The magnetic flux generated by the current flowing through the coil conductor 22 impinges on the terminal electrodes 19 and 20 and the circulating induced currents i circulate and flow through the terminal electrodes 19 and 20. Here, in FIG. 4, the induced current i flowing through the terminal electrode 20 is not illustrated. Hereinafter, the same can be said for each of the other preferred embodiments of the present invention. However, as the induced current i is generated only at a great distance away from the coil conductor 22 because of the dividing grooves 15 and 16, it is difficult for the induced current i to flow through the terminal electrodes 19 and 20. Therefore, an inductor 10 having a very high Q-factor and inductance of the coil conductor 22 is provided.

The function of the terminal electrodes 19 and 20 as a short-circuited ring can be reliably decreased by setting the length of the dividing grooves 15 and 16 to be at least half of the diameter of the spiral coil conductor 22. The length of the dividing grooves 15 and 16 is preferably substantially equal to or greater than the diameter of the spiral coil conductor 22. However, when the Q-factor and the impedance are not required to be so high, a length of the dividing grooves 15 and 16 which is less than half the diameter of the spiral coil conductor 22 may be used.

Furthermore, in the inductor 10, only the dividing grooves 15 and 16 and the terminal electrodes 20 and 19 are provided. Thus, its dimensions of the inductor are greatly decreased compared with the conventional inductor in which the distance between the coil conductor 22 and the terminal electrodes 19 and 20 is increased by providing extra lead-in patterns. Furthermore, when the inductor 10 is mounted on a printed wiring board or other substrate, it is desirable to mount the inductor 10 so that the surface having the dividing grooves 15 and 16 faces upward in order not to short-circuit the dividing grooves 15 and 16 by solder, conductive adhesive, or such material.

Figure 5:
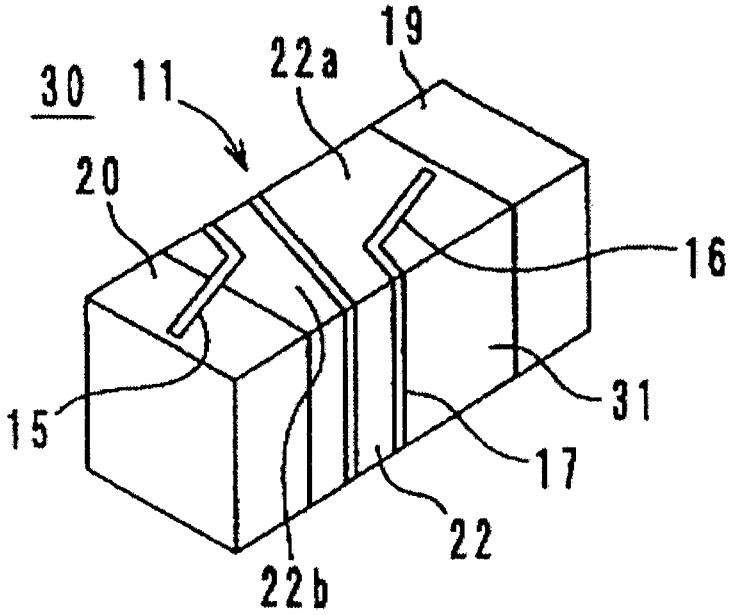
FIG. 5 is a perspective view of a second preferred embodiment of the inductor according to the present invention.

As shown in FIG. 5, in an inductor 30 of the second preferred embodiment, a spiral coil conductor 22 is provided in a location displaced to the left from the middle of the inductor. Accordingly, between the coil conductor 22 and a terminal electrode 19, a substantially circular electrode 31 which extends nearly around a winding core 11 and which is located outside the coil conductor 22 is formed. Furthermore, in FIG. 5, the same reference numerals are assigned to corresponding elements in FIG. 1 and repetitive explanations thereof are omitted.

In this case, a dividing groove 15 extends from the terminal end portion 22*b* of the coil conductor 22 over a terminal electrode 20. A dividing groove 16 extends from the starting end 22*a* of the coil conductor 22 over the substantially circular electrode 31 and does not reach the terminal electrode 19. The dividing grooves 15 and 16 are arranged so as to extend in a direction which is oblique to the winding direction of the spiral coil conductor 22.

Figure 6:
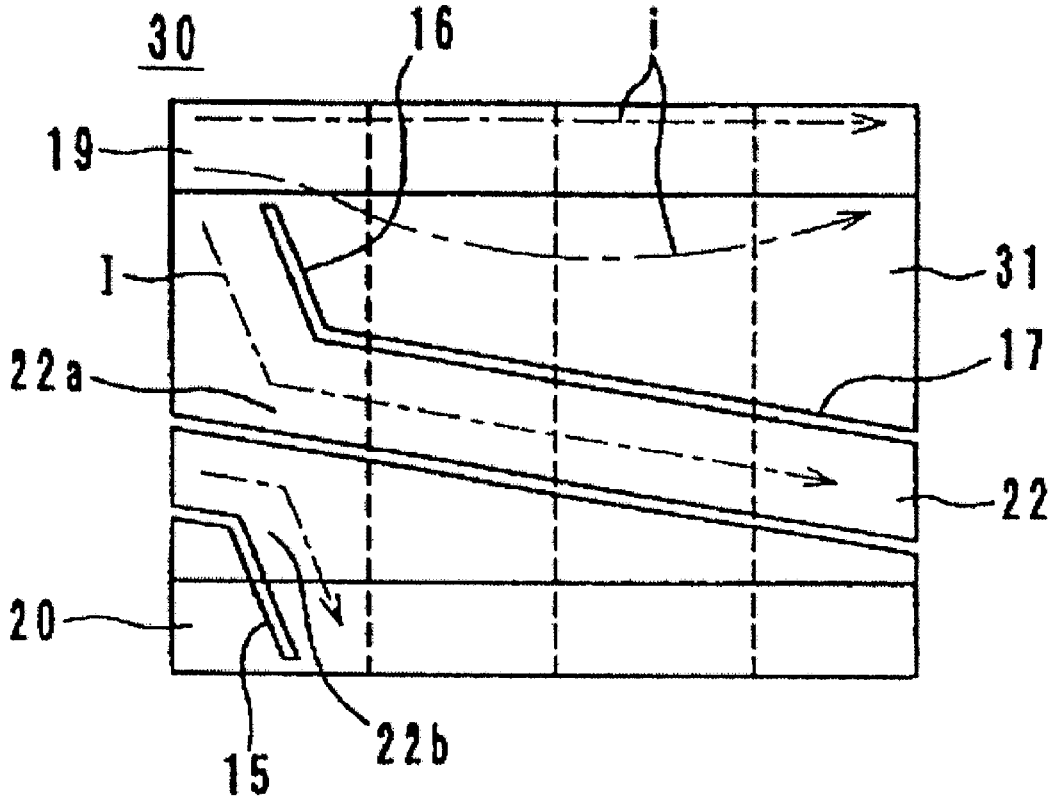
FIG. 6 is a development view of the inductor shown in FIG. 5.

Thus, since the nearly circular terminal electrode 20 and substantially circular electrode 31 are partially divided by the dividing grooves 15 and 16, respectively, the electrodes 20, 31 are prevented from functioning as a short-circuited ring. That is, as shown in FIG. 6, when the magnetic flux generated by the current I flowing through the coil conductor 22 crosses the substantially circular electrode 31 and terminal electrodes 19 and 20, the induced currents i circulate and flow through the substantially circular electrode 31 and the terminal electrodes 19 and 20, respectively. However, as the induced currents i are generated only at a great distance away from the coil conductor 22 because of the dividing grooves 15 and 16, it is difficult for the induced currents i to flow through the substantially circular electrode 31 and the terminal electrodes 19 and 20. Therefore, an inductor 30 having very high Q-factor and inductance of the coil conductor 22 is provided.

Figure 7:
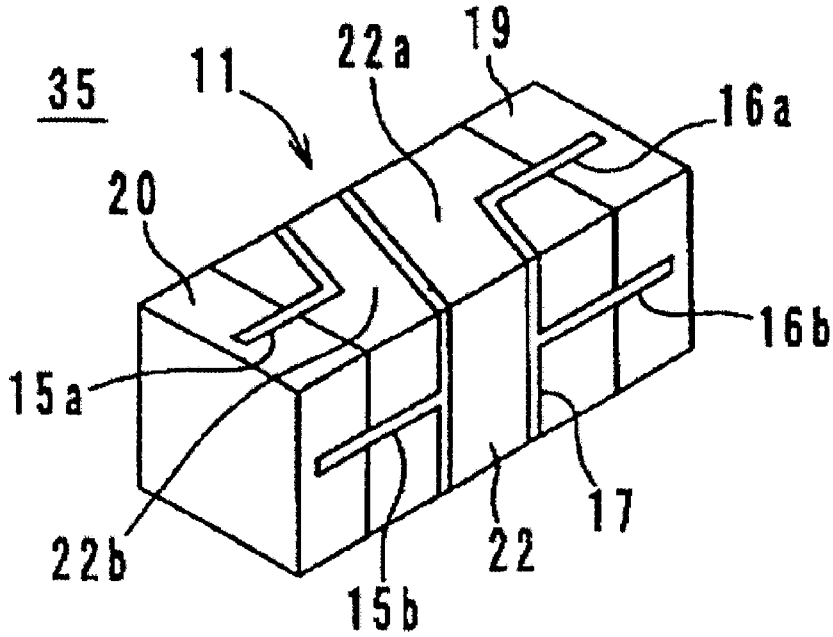
FIG. 7 is a perspective view showing a third preferred embodiment of the inductor according to the present invention.
Figure 8:
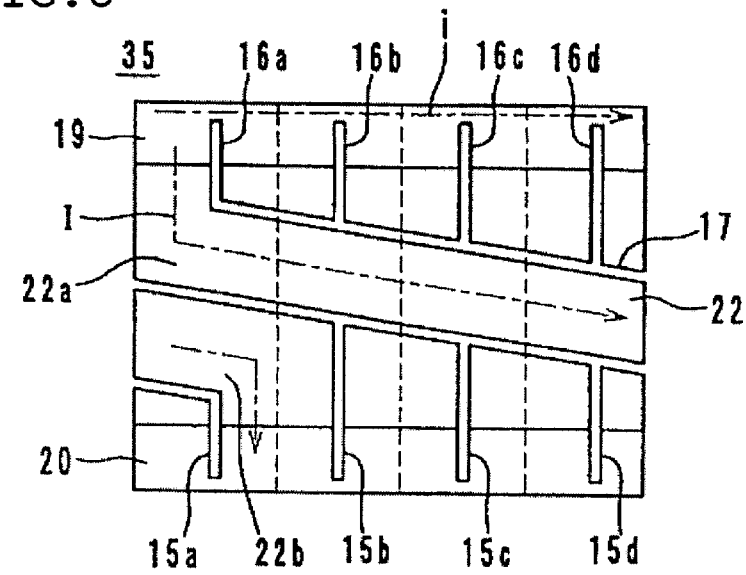
FIG. 8 is a development view of the inductor shown in FIG. 7.

As shown in FIGS. 7 and 8, in an inductor 35 of the third preferred embodiment, dividing grooves 15*a*–15*d* and 16*a*–16*d* are formed on the four external surfaces of a winding core 11, respectively. Since the nearly circular terminal electrodes 19 and 20 are divided by the dividing grooves 15*a*–15*d* and 16*a*–16*d*, respectively, induced currents are generated only at a great distance away from the coil conductor 22. Therefore, the terminal electrodes 19 and 20 are even more effectively prevented from functioning as a short-circuited ring compared with the case of the first preferred embodiment.

Figure 9:
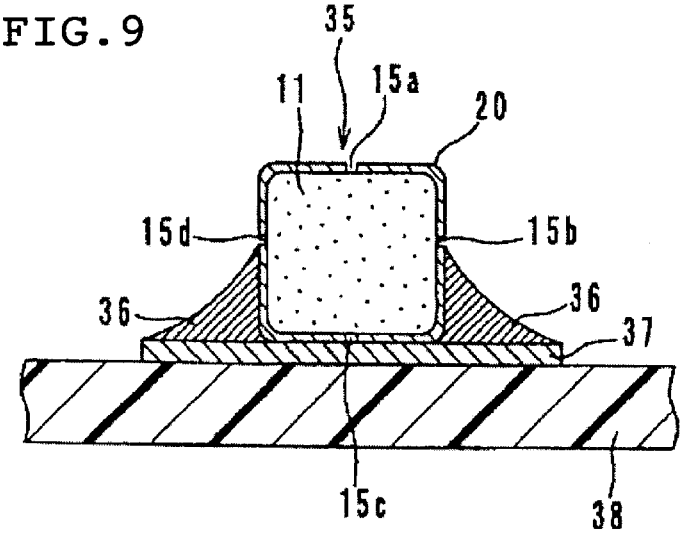
FIG. 9 is a sectional view showing the condition where the inductor in FIG. 7 is mounted.

Furthermore, by providing the dividing grooves 15*a*–15*d* and 16*a*–16*d* on the four external surfaces (that is, every ninety degrees around the winding core 11), it is possible to eliminate the directional properties at the time the inductor 35 is mounted. FIG. 9 shows the condition where the inductor 35 is surface mounted on the pattern 37 of a printed wiring board 38 using solder 36. The terminal electrodes 19 and 20 are electrically connected to the pattern 37 through the solder 36. The dividing grooves 15*a*, 15*b*, 15*d*, 16*a*, 16*b*, and 16*d* are seldom short-circuited by the solder 36. Even if the dividing grooves 15*b*, 15*d*, 16*b*, and 16*d* are short-circuited by the solder 36, the terminal electrodes 19 and 20 are prevented from functioning as a short-circuited ring by the diving grooves 15*a* and 16*a* provided on the upper surface.

Furthermore, inductors according to the present invention are not limited to the above-described preferred embodiments and various modifications are possible within the spirit and the scope of the invention. For example, the coil conductor may be a conductive wire wound around the external surface of a winding core material. Furthermore, an inductor having a built-in capacitor may be constructed by arranged a dielectric layer so as to cover a coil conductor and providing a capacitor electrode on the dielectric layer. Other inductors having a built-in electrical component such as a resistor may also be constructed.

Figure 10:
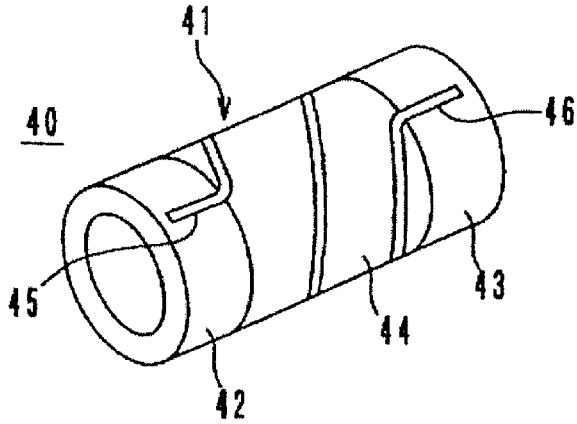
FIG. 10 is a perspective view showing another preferred embodiment of the present invention.
Figure 11:
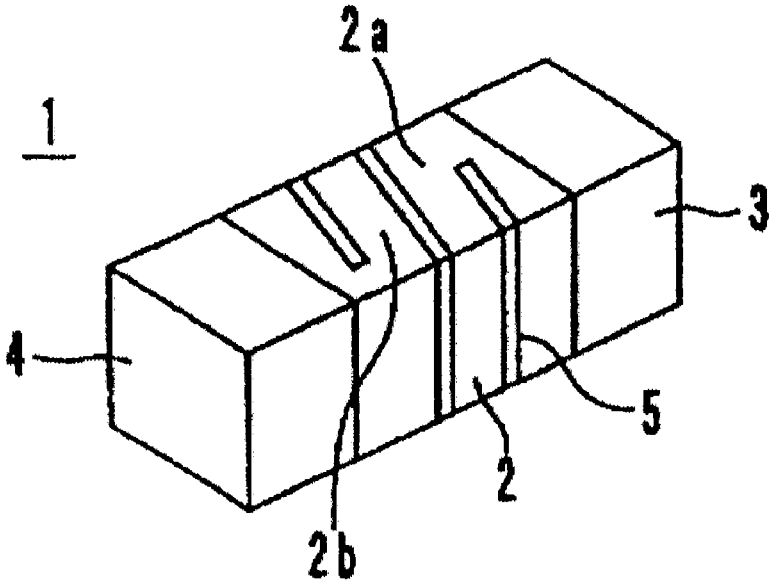
FIG.11 PRIOR ART
FIG. 11 is a perspective view showing a conventional inductor.
Figure 12:
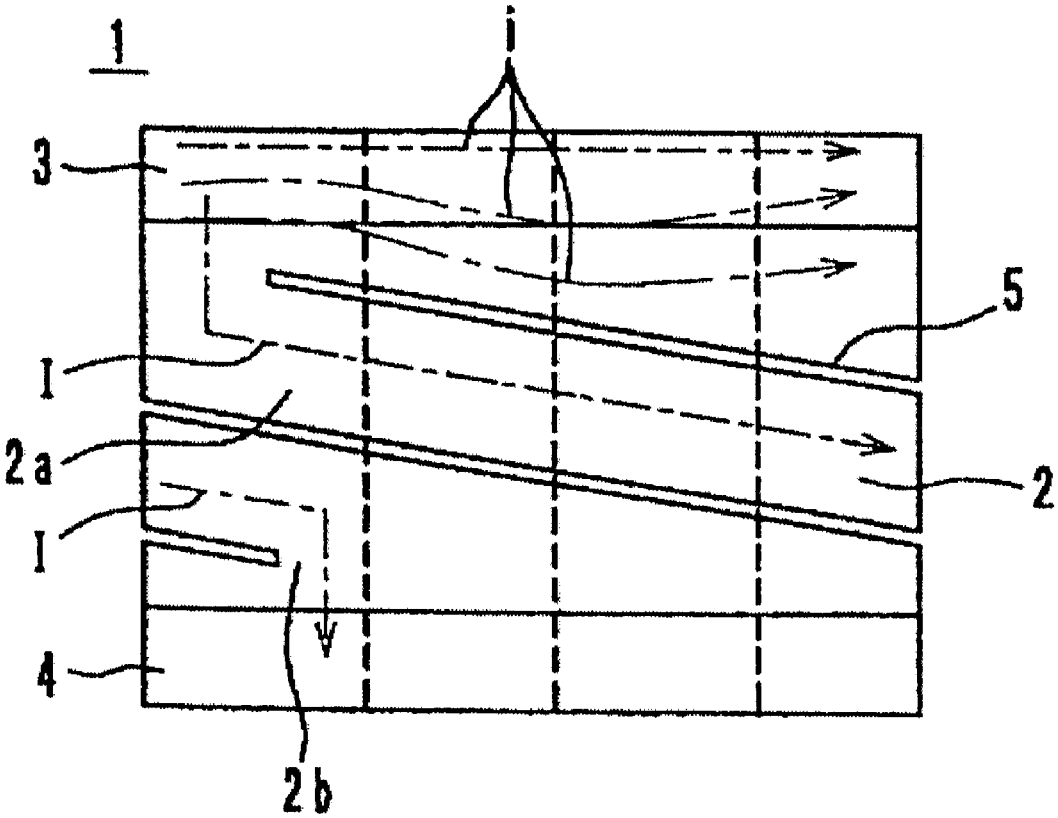
FIG.12 PRIOR ART
FIG. 12 is a development view of the inductor shown in FIG. 11.

Furthermore, an inductor 40 shown in FIG. 10 may be constructed. In the inductor 40, input-output terminal electrodes 42 and 43 are provided on both ends of a substantially cylindrical winding core material 41 on the external surface of which a spiral coil conductor 44 is provided. The substantially circular input-output terminal electrodes 42 and 43 are partially divided by dividing grooves 45 and 46.

It should be understood that the foregoing description is only illustrative of preferred embodiments of the present invention. Various alternatives and modifications can be devised by those skilled in the art without departing from the present invention. Accordingly, the present invention is intended to embrace all such alternatives, modifications and variations that fall within the scope of the appended claims.

What is claimed is:

1. An inductor comprising:

a winding core having an external surface and two end surfaces provided at ends of the external surface;

a coil conductor spirally extending around the external surface of the winding core;

a plurality of substantially circular electrodes extending nearly around the winding core and located outside of the coil conductor, said plurality of substantially circular electrodes being provided at both of said ends surfaces of the winding core; and dividing grooves located in the external surface of the winding core and extending from end portions of the coil conductor into the substantially circular electrodes so as to partially divide the substantially circular electrodes.

2. An inductor according to claim 1, wherein the length of the dividing grooves is substantially equal to at least one-half of the diameter of the coil conductor extending spirally therearound.

3. An inductor according to claim 1, wherein the winding core has a substantially columnar configuration and a substantially rectangular transverse cross section.

4. An inductor according to claim 1, wherein the winding core is magnetic and includes at least one of ferrite, a ceramic material, and a resin material.

5. An inductor according to claim 1, further comprising a thin-film conductor material disposed on the external surface of the coil conductor.

6. An inductor according to claim 5, wherein the dividing grooves are formed in the thin film conductor material.

7. An inductor according to claim 1, further comprising input-output terminal electrodes having a substantially circular shape and arranged to extend around the winding core.

8. An inductor according to claim 1, wherein the spiral coil conductor is located at the approximate middle of the winding core.

9. An inductor according to claim 1, wherein the spiral coil conductor is located spaced to the left of the approximate middle of the winding core.

10. An inductor according to claim 9, wherein the dividing grooves are arranged so as to extend in a direction which is oblique to the winding direction of the spiral coil conductor.

11. An inductor according to claim 1, wherein the winding core includes four external surfaces and the dividing grooves are located on each of the four external surfaces of a winding core.

12. An inductor comprising:

a winding core having an external surface and two end surfaces provided at ends of the external surface;

a coil conductor spirally extending around the external surface of the winding core;

a plurality of substantially circular electrodes extending nearly around the winding core and located outside of the coil conductor, said plurality of substantially circular electrodes being provided at both of said ends surfaces of the winding core; and dividing grooves located in the external surface of the winding core and arranged to partially divide the substantially circuit electrodes to prevent the substantially circular electrodes from defining a short-circuited ring.

13. An inductor according to claim 12, wherein the dividing grooves are arranged to extend from the end portions of the coil conductor into the substantially circular electrodes.

14. An inductor according to claim 12, wherein the length of the dividing grooves is substantially equal to at least one-half of the diameter of the coil conductor extending spirally therearound.

15. An inductor according to claim 12, wherein the winding core has a substantially columnar configuration and a substantially rectangular transverse cross section.

16. An inductor according to claim 12, wherein the winding core is magnetic and includes at least one of ferrite, a ceramic material, and a resin material.

17. An inductor according to claim 12, further comprising a thin-film conductor material disposed on the external surface of the coil conductor.

18. An inductor according to claim 17, wherein the dividing grooves are formed in the thin film conductor material.

19. An inductor according to claim 17, further comprising input-output terminal electrodes having a substantially circular shape and arranged to extend around the winding core.

20. An inductor according to claim 12, wherein the spiral coil conductor is located at the approximate middle of the winding core.

21. An inductor according to claim 12, wherein the spiral coil conductor is located spaced to the left of the approximate middle of the winding core.

22. An inductor according to claim 21, wherein the dividing grooves are arranged so as to extend in a direction which is oblique to the winding direction of the spiral coil conductor.

23. An inductor according to claim 12, wherein the winding core includes four external surfaces and the dividing grooves are located on the four external surfaces of a winding core.

* * * * *